US008323056B2

(12) United States Patent
Clausen

(10) Patent No.: US 8,323,056 B2
(45) **Date of Patent: *Dec. 4, 2012**

(54) COAXIAL CONNECTOR FOR CORRUGATED CABLE WITH CORRUGATED SEALING

(75) Inventor: Jan Michael Clausen, Vordingborg (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/372,086

(22) Filed: Feb. 13, 2012

(65) Prior Publication Data

US 2012/0149239 A1 Jun. 14, 2012

Related U.S. Application Data

(63) Continuation of application No. 12/765,473, filed on Apr. 22, 2010, now Pat. No. 8,113,878.

(51) Int. Cl.
*H01R 9/05* (2006.01)

(52) U.S. Cl. ..... 439/584

(58) Field of Classification Search ..... 439/578, 439/583, 584, 607.42

See application file for complete search history.

(56) References Cited

U.S. PATENT DOCUMENTS 7,249,969 B2 * 7/2007 Paynter ..... 439/578
8,113,878 B2 * 2/2012 Clausen ..... 439/584

* cited by examiner

*Primary Examiner* — Phuong Dinh

(57) ABSTRACT

A coaxial cable connector includes an internally corrugated member, an internally corrugated sealing member, and a back nut. Axial advancement of the back nut causes a back end of the internally corrugated member to compress radially inwardly.

8 Claims, 4 Drawing Sheets

COAXIAL CONNECTOR FOR CORRUGATED CABLE WITH CORRUGATED SEALING

CROSS-REFERENCE TO RELATED APPLICATIONS

This application is a continuation of U.S. application Ser. No. 12/765,473 filed on Apr. 22, 2010 now U.S. Pat. No. 8,113,878 the content of which is relied upon and incorporated herein by reference in its entirety.

BACKGROUND OF THE INVENTION

1. Field of the Invention

The present invention relates generally to connectors for coaxial cables, and particularly to connectors for coaxial cables that have helically corrugated outer conductors.

2. Technical Background

Coaxial cable is characterized by having an inner conductor, an outer conductor, and an insulator between the inner and outer conductors. The inner conductor may be hollow or solid. At the end of coaxial cable, a connector is attached to allow for mechanical and electrical coupling of the coaxial cable.

Connectors for coaxial cables have been used throughout the coaxial cable industry for a number of years, including connectors for coaxial cables having helically corrugated outer conductors. Accordingly, there is a continuing need for improved high performance coaxial cable connectors.

SUMMARY OF THE INVENTION

One aspect of the invention is a coaxial cable connector configured to provide an electrically conductive coupling to a coaxial cable. The coaxial cable includes a center conductor, a cable jacket, and an outer conductor. The connector includes a body that includes a front end, a back end, and an internal bore. The connector also includes a coupling nut rotatably secured to the front end of the body. In addition, the connector includes a back nut rotatably secured to the back end of the body. The back nut includes an internal bore. The connector further includes an internally corrugated member at least partially disposed within the internal bore of the body and the internal bore of the back nut. The internally corrugated member includes a front end and a back end, an internal bore, and an internal corrugated area. The connector additionally includes an internally corrugated sealing member disposed within the internal bore of the internally corrugated member. The internally corrugated sealing member includes an internal corrugated area. Axial advancement of the back nut in the direction of the front end of the body causes at least a portion of the back end of the internally corrugated member to compress radially inwardly.

In another aspect, the present invention provides a method of coupling a coaxial cable having a center conductor, a cable jacket, and an outer conductor to a coaxial cable connector. The method includes inserting a prepared end of the coaxial cable into a coaxial cable connector. The connector includes a body having a front end, a back end, and an internal bore. The connector also includes a coupling nut rotatably secured to the front end of the body. In addition, the connector includes a back nut rotatably secured to the back end of the body. The back nut includes an internal bore. The connector further includes an internally corrugated member at least partially disposed within the internal bore of the body and the internal bore of the back nut. The internally corrugated member includes a front end and a back end, an internal bore, and an internal corrugated area. The connector additionally includes an internally corrugated sealing member disposed within the internal bore of the internally corrugated member. The internally corrugated sealing member includes an internal corrugated area. The method also includes axially advancing the back nut in the direction of the front end of the body thereby causing at least a portion of the back end of the internally corrugated member to compress radially inwardly.

Preferred embodiments of the present invention can provide for at least one potential advantage including, but not limited to, simplified connector installation, simplified connector component geometry, positive mechanical captivation of cable and environmental sealing along multiple contact points, reduced installation time, installation or removal without the use of special tools, and/or improved electrical performance (common path distortion) due to connector/cable junction stability.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
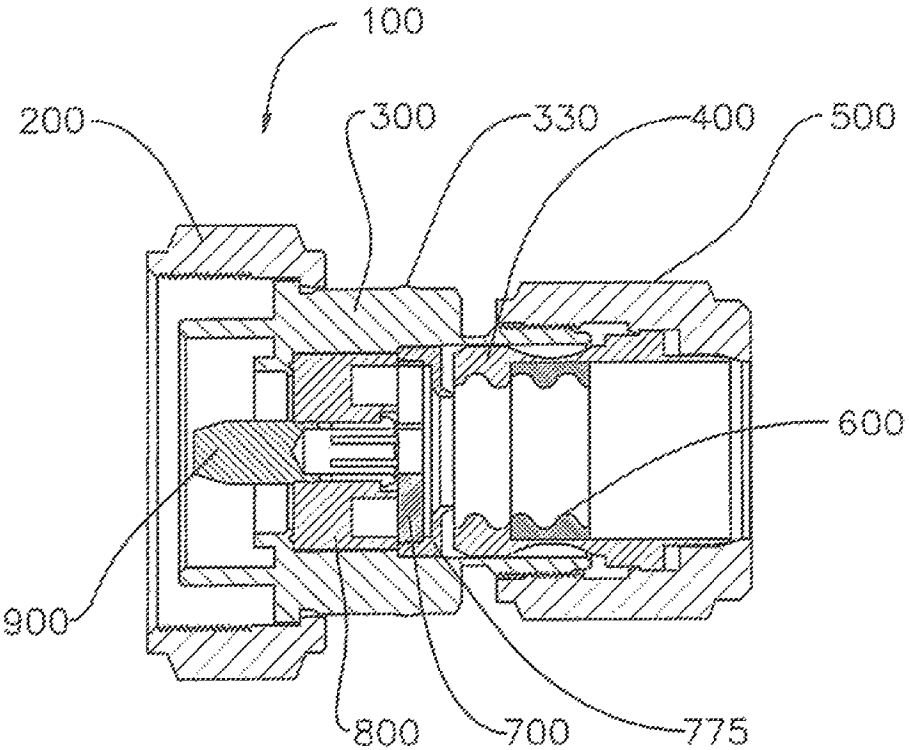
FIG. 1 illustrates a partial cross sectional view of a first embodiment of the present invention.

FIG. 1 illustrates a partial cross sectional view of a first preferred embodiment of the invention in which connector 100 is shown in a state ready to receive a corrugated coaxial cable. In FIG. 1, insulator 800, contact 900, insulator 700, ring 775 and internally corrugated member 400, have been factory installed into, and secured within body 300, by means of a light, temporary press fit between body 300 and internally corrugated member 400. Coupling nut 200 is secured about body 300 by means of pressing coupling nut 200 past a light interference over bump 330 thereby allowing coupling nut 200 to rotate about body 300 with limited axial movement. Internally corrugated sealing member 600 is disposed within internally corrugated member 400.

Figure 2:
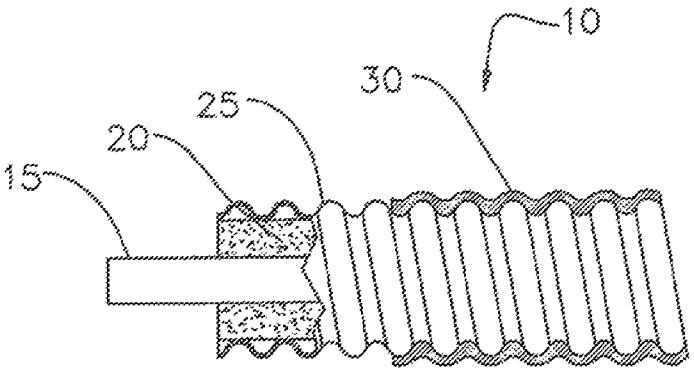
FIG. 2 illustrates a partial cross sectional view of a prepared end of a corrugated coaxial cable.

FIG. 2 illustrates a partial cross sectional view of the prepared end of a corrugated coaxial cable 10 including center conductor 15, dielectric 20, corrugated outer conductor 25, and cable jacket 30.

Figure 3:
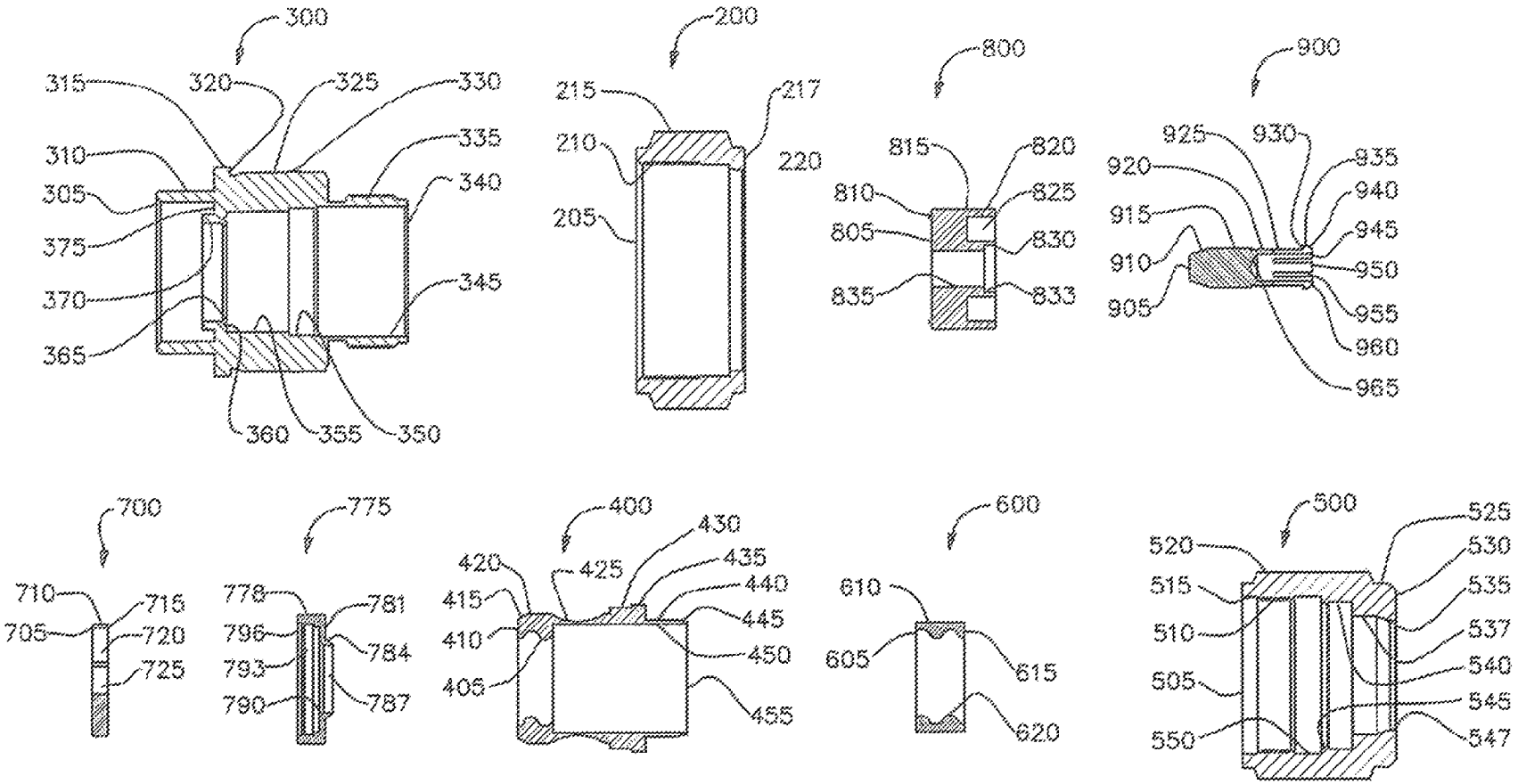
FIG. 3 illustrates an exploded view of the embodiment illustrated in FIG. 1.

FIG. 3 illustrates an exploded view of a preferred embodiment of connector 100 including body 300, coupling nut 200, insulator 800, contact 900, insulator 700, ring 775, internally corrugated member 400, internally corrugated sealing member 600, and back nut 500. Moving from left to right across FIG. 3.

Body 300 includes front end 305, interface outside diameter 310, outer diameter 315, rearward facing annular shoulder 320, outer diameter 325, bump 330, externally threaded portion 335, back end 340, internal bores 345, 350, and 355, rearward facing annular groove 360, through-bore 365, internal bore 370, and trepan 375. Body 300 is preferably made from a metallic material, such as brass, and is preferably plated with a conductive, corrosion resistant material, such as a nickel-tin alloy.

Coupling nut 200 includes front end 205, internally threaded portion 210, outer surface 215, back end 217, and through-bore 220. Coupling nut 200 is preferably made from a metallic material, such as brass, and is preferably plated with a conductive, corrosion resistant material, such as a nickel-tin alloy.

Insulator 800 includes front end 805, raised tapered annular ring 810, outside diameter 815, back end 820, a plurality of impedance matching holes 825, internal bore 830, reward facing annular surface 833 and through-bore 835. Insulator 800 is preferably made from an electrically insulative material, such as polymethylpentene commercially known as TPX®.

Contact 900 includes front end 905, tapered portion 910, straight portion 915, bump 920, outer diameter 925, forward facing annular shoulder 930, outer diameter 935, tapered portion 940, internal bore 945, a plurality of contact tines 950, a plurality of slots 955, back end 960, and optional bore 965. Contact 900 is preferably made from a metallic material, such as beryllium copper, is preferably heat treated and is preferably plated with a conductive, corrosion resistant material, such as a nickel-tin alloy.

Insulator 700 includes front end 705, outside diameter 710, back end 715, a plurality of impedance matching holes 720, and through-bore 725. Insulator 700 is preferably made from an electrically insulative material, such as acetal commercially known as Delrin®.

Ring 775 includes front end 796, outside diameter 778, back end 781, tapered protrusion 784, through-bore 787, internal tapered area 790 and internal bore 793. Ring 775 is preferably made from a metallic material, such as brass, and is preferably plated with a conductive, corrosion resistant material, such as silver.

Internally corrugated member 400 includes internal corrugated area 405, front end 410, angled outer surface 415, outer diameter 420, outer concave surface 425, outer surfaces 430, 435, and 440, chamfer 445, internal bore 450, and back end 455. The length of the internal bore 450 in the axial direction is preferably longer than the length of the internal corrugated area 405 in the axial direction. That is, internal corrugated area 405 preferably makes up less than 50% of the axial length of the internally corrugated member 400, and even more preferably makes up less than 30% of the axial length of the internally corrugated member 400. Internally corrugated member 400 is preferably made from a conformable plastic material, such as acetal commercially known as Delrin®.

Internally corrugated sealing member 600 includes front end 605, outer diameter 610, back end 615, and internal corrugated area 620. Internally corrugated sealing member 600 is preferably made from a rubber-like material, such as EPDM (Ethylene Propylene Diene Monomer) or, alternatively, silicone. When internally corrugated sealing member 600 is disposed within internal bore 450 of internally corrugated member 400 as shown in FIG. 1, it is preferably surrounded by portion of internally corrugated member 400 having outer concave surface 425. Preferably, the axial length of internally corrugated sealing member 600 is less than 30% of the axial length of internally corrugated member 400. Preferably, the axial length of internally corrugated sealing member 600 is less than 50% of the axial length of internal bore 450 of internally corrugated member 400.

Back nut 500 includes front end 505, internally threaded portion 510, counter bore 515, external shape 520, outside diameter 525, back end 530, internal tapered portion 535, counter bore 537, counter bore 540, through-bore 545, through-bore 547, and internal bore 550. Back nut 500 is preferably made from a metallic material, such as brass, and is preferably plated with a conductive, corrosion resistant material, such as a nickel-tin alloy.

Figure 4:
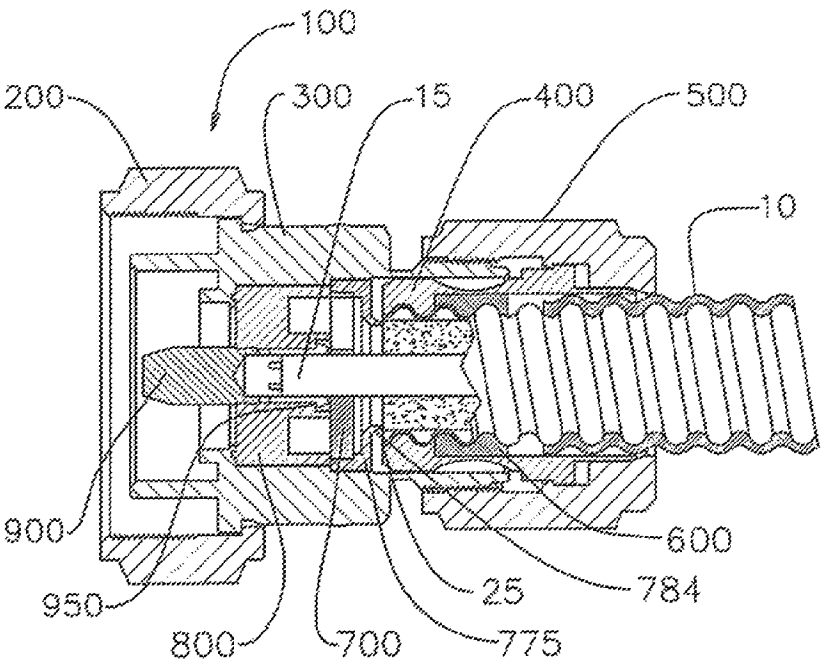
FIG. 4 illustrates a partial cross sectional view of the embodiment illustrated in FIG. 1 in a first stage of assembly with a corrugated coaxial cable.

FIG. 4 illustrates connector 100 at a first stage of assembly wherein prepared end of cable 10 is inserted into connector 100 through back nut 500. Cable outer conductor 25 is engaged with internally corrugated sealing member 600 and with internally corrugated member 400. Outer surface 430 of internally corrugated member 400 has a smaller diameter than through bore 545 of back nut 500 and outer surface 435 has a larger diameter than through bore 545 of back nut 500 providing a mechanical stop between internally corrugated member 400 and back nut 500, limiting forward axial movement of internally corrugated member 400 and thereby providing a gap between front end 410 of internally corrugated member 400 and ring 775. The interior of cable outer conductor 25 is annularly disposed about tapered protrusion 784 of ring 775. Cable center conductor 15 passes through insulator 700 and is mechanically and electrically in communication with contact 900 by means of radial inward compressive forces exerted by a plurality of contact tines 950.

Figure 5:
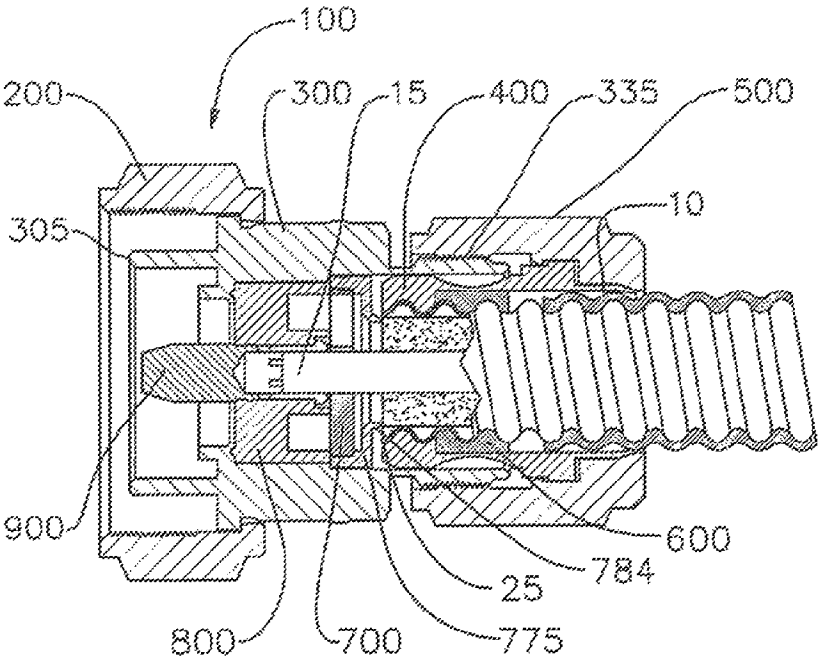
FIG. 5 illustrates a partial cross sectional view of the embodiment illustrated in FIG. 1 in a second stage of assembly with a corrugated coaxial cable.

FIG. 5 illustrates a partial cross sectional view with the connector 100 and cable 10 at a second stage of assembly wherein back nut 500 is threadedly advanced upon threaded portion 335 of body 300 thereby axially advancing back nut 500 in the direction of front end 305 of body 300 and initiating radially inwardly compressive movement of back end 455 of internally corrugated member 400.

Figure 6:
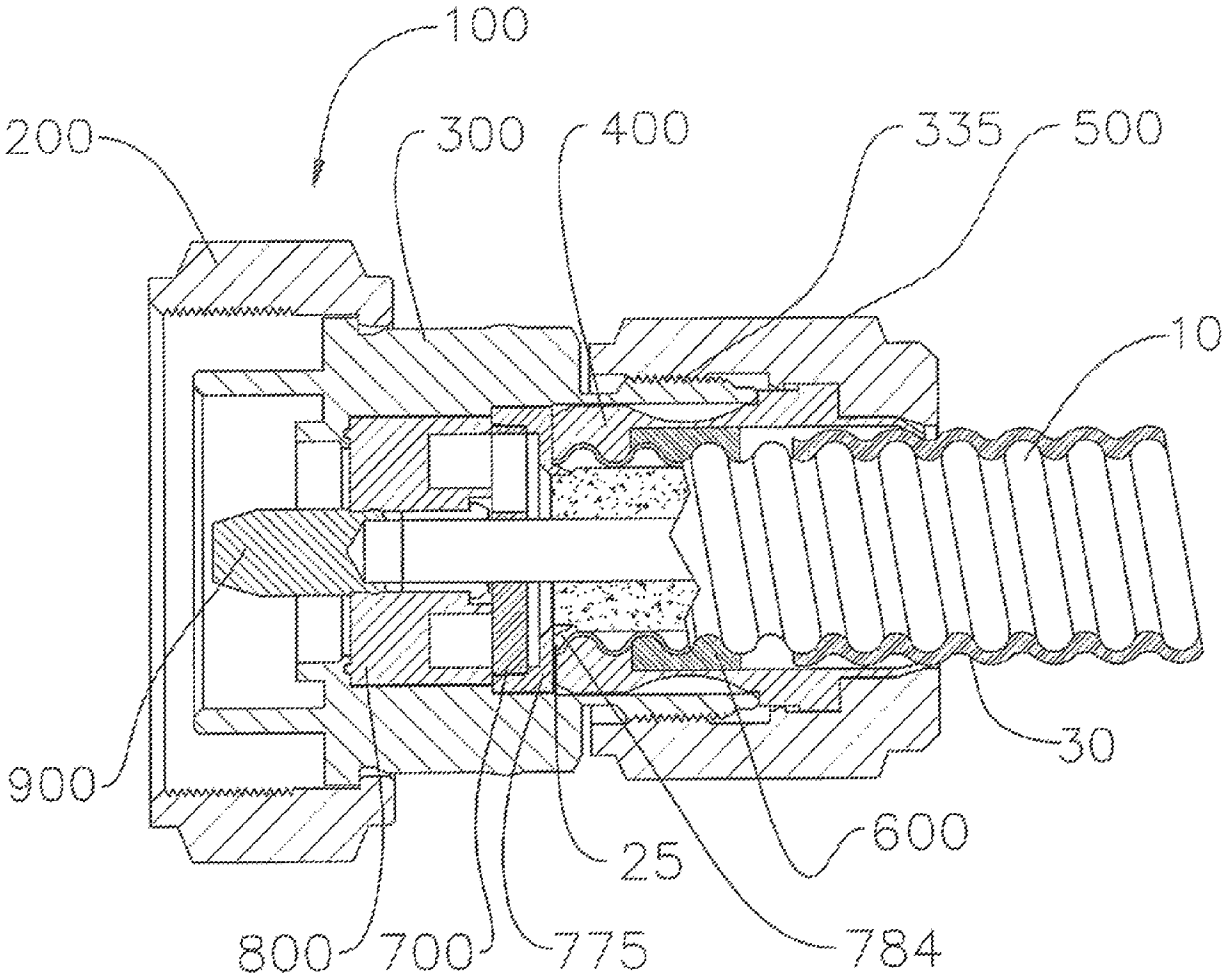
FIG. 6 illustrates a partial cross sectional view of the embodiment illustrated in FIG. 1 in a final stage of assembly with a corrugated coaxial cable.

FIG. 6 illustrates a partial cross sectional view with the connector 100 and cable 10 at a third and final stage of assembly. Back nut 500 is fully tightened onto threaded portion 335 of body 300 fully compressing back end 455 of internally corrugated member 400. Internally corrugated sealing member 600 conforms or at least partially conforms to contours of cable 10, specifically cable outer conductor 25, and internally corrugated member 400. Cable jacket 30 and back nut 500 provide mechanical support and environmental sealing by sandwiching back end 455 of internally corrugated member 400, which as shown in FIG. 6 is compressed radially inwardly by back nut 500, specifically by internal tapered portion 535. Additional mechanical support and environmental sealing is provided by the sandwiching of internally corrugated sealing member 600 between cable outer conductor 25 and internally corrugated member 400. Accordingly, a dual clamping and sealing mechanism is provided with a first clamping and sealing provided by sandwiching internally corrugated sealing member 600 between cable outer conductor 25 and internally corrugated member 400 and second clamping and sealing provided by sandwiching back end 455 of internally corrugated member 400 between back nut 500 and cable jacket 30. Cable outer conductor 25 is formed against internal corrugated area 405 of internally corrugated member 400, against internal corrugated area 620 of internally corrugated sealing member 600, and is clamped or sandwiched between internally corrugated member 400 and tapered portion 784 of ring 775 providing electrical and mechanical communication between connector 100 and cable 10.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A coaxial cable connector configured to provide an electrically conductive coupling to a coaxial cable comprising a center conductor, a cable jacket, and an outer conductor, the connector comprising:

a body comprising a front end, a back end, and an internal bore;

a back nut rotatably secured to the back end of the body, the back nut comprising an internal bore; and an internally corrugated member at least partially disposed within the internal bore of the body and the internal bore of the back nut;

wherein axial advancement of the back nut in the direction of the front end of the body causes at least a portion of the back end of the internally corrugated member to compress radially inwardly.

2. The coaxial cable connector of claim 1, wherein the internally corrugated member comprises a front end and a back end, an internal bore, and an internal corrugated area.

3. The coaxial cable connector of claim 2, further comprising a first clamping and sealing mechanism.

4. The coaxial cable connector of claim 3, wherein the first clamping and sealing mechanism comprises the back end of the internally corrugated member being sandwiched between the back nut and the cable jacket in a final stage of assembly with the coaxial cable.

5. The coaxial cable connector of claim 2, further comprising an internally corrugated sealing member disposed within the internal bore of the internally corrugated member, the internally corrugated sealing member comprising an internal corrugated area.

6. The coaxial cable connector of claim 5, further comprising a second clamping and sealing mechanism.

7. The coaxial cable connector of claim 5, wherein the second clamping and sealing mechanism comprises the internally corrugated sealing member being sandwiched between the internally corrugated member and the outer conductor in a final stage of assembly with the coaxial cable.

8. The coaxial cable connector of claim 5, wherein the internally corrugated sealing member is less than 50% of an axial length of the internal bore of the internally corrugated member.

* * * * *